US008986173B1

(12) United States Patent
Adams

(10) Patent No.: US 8,986,173 B1
(45) Date of Patent: Mar. 24, 2015

(54) DUMBBELL WITH RESISTANCE BANDS

(71) Applicant: Elijah D. Adams, Paso Robles, CA (US)

(72) Inventor: Elijah D. Adams, Paso Robles, CA (US)

( * ) Notice: Subject to any disclaimer, the term of this patent is extended or adjusted under 35 U.S.C. 154(b) by 105 days.

(21) Appl. No.: 13/947,535

(22) Filed: Jul. 22, 2013

Related U.S. Application Data

(60) Provisional application No. 61/675,058, filed on Jul. 24, 2012.

(51) Int. Cl.
*A63B 21/072* (2006.01)
*A63B 21/075* (2006.01)
*A63B 21/02* (2006.01)

(52) U.S. Cl.
CPC ..... *A63B 21/028* (2013.01); *A63B 21/0726* (2013.01)
USPC ..... 482/106; 482/126; 482/108

(58) Field of Classification Search
CPC ..... A63B 21/00058; A63B 21/00069; A63B 21/02; A63B 21/04; A63B 21/0407; A63B 21/0435; A63B 21/055; A63B 21/0552; A63B 21/0555; A63B 21/0557; A63B 21/06; A63B 21/072; A63B 21/0724
USPC ..... 482/81, 82, 92, 93, 104–108, 121–129, 482/32, 135–136, 141
See application file for complete search history.

(56) References Cited

U.S. PATENT DOCUMENTS 610,416 A * 9/1898 Sandow ..... 482/108
1,421,198 A * 6/1922 Fidora ..... 482/126
4,059,265 A * 11/1977 Wieder et al. ..... 482/125
4,090,706 A * 5/1978 Reda ..... 482/122
D263,328 S * 3/1982 Cooper ..... D21/693
4,361,324 A * 11/1982 Baroi ..... 482/108
4,722,523 A * 2/1988 Yang ..... 482/108
4,787,624 A * 11/1988 Grant ..... 482/82
5,125,649 A * 6/1992 Fuller ..... 482/123
5,236,405 A * 8/1993 Dohmann et al. ..... 482/82
5,499,961 A * 3/1996 Mattox ..... 482/132
5,518,478 A * 5/1996 Liang ..... 482/108
5,620,397 A * 4/1997 Chieh ..... 482/46
5,697,871 A * 12/1997 Landfair ..... 482/82
5,842,956 A * 12/1998 Strachan ..... 482/82
5,871,423 A * 2/1999 Pruchnik ..... 482/110
6,551,222 B1 * 4/2003 Beaver ..... 482/82
6,672,997 B1 * 1/2004 Winkler ..... 482/126
7,322,909 B1 1/2008 Loccarini et al.
7,387,599 B1 * 6/2008 Hsu ..... 482/132
7,628,735 B1 * 12/2009 Hsu ..... 482/82
7,695,413 B1 4/2010 Cruz et al.
2011/0098159 A1 * 4/2011 Wiseman ..... 482/108
2012/0040809 A1 * 2/2012 Formicola ..... 482/131

* cited by examiner

*Primary Examiner* — Stephen Crow
*Assistant Examiner* — Garrett Atkinson
(74) *Attorney, Agent, or Firm* — Robert C Montgomery; Mongomery Patent & Design

(57) ABSTRACT

Dumbbells with resistance bands suitable for performing a variety of exercises are described. The dumbbells with resistance bands include a pair of resistance bands that are affixed to opposing ends of dumbbell weights. Each dumbbell weight includes a means to adjust the length of a band as well as a locking mechanism. The length of each band may be adjusted and locked to provide varying levels of resistance.

19 Claims, 5 Drawing Sheets

DUMBBELL WITH RESISTANCE BANDS

RELATED APPLICATIONS

The present invention was first described in and claims the benefit of U.S. Provisional Application No. 61/675,058, filed Jul. 24, 2012, the entire disclosures of which are incorporated herein by reference.

FIELD OF THE INVENTION

The presently disclosed subject matter is directed to exercise equipment. More particularly the disclosed subject matter relates to dumbbells with resistance bands that are suitable for performing a variety of exercises.

BACKGROUND OF THE INVENTION

Fitness and health concerns are among the areas of highest concern in today's society. Health club memberships are at an all time high. People are striving to maintain a balanced life style, which includes a healthy one. This proves to be difficult in our modern society. Most of us work in a service industry, which forces us to become more sedentary than we would like. Yet, we are very busy, and find it difficult to allocate enough time to make up for the lack in physical activity we experience. This is especially true when the time required to satisfy our work obligations is compounded with other duties such as family, children, yard work, and the like. Our exercise routines must consist of extremely efficient workouts to make up for our sedentary lifestyles without taking away from the normal tasks that we need to do throughout the day. Weight training with free weights is a common and beneficial form of exercise. One (1) type of free weight is a dumbbell that can be used individually or in pairs. Resistance training, another common form of exercise, can be performed with elastic bands or hydraulic resistance machinery among other types of equipment. One (1) problem encountered during exercise is how to combine weight training with resistance training in order to have a more productive workout. Makeshift devices that combine these two (2) forms of exercise can be haphazard and prone to cause more harm than good. Accordingly, there exists a need for a means by which a combined weight and resistance training can be achieved within one device. The development of the present invention fulfills this need.

Prior art in this field consists of either a resistance band or a weight, but not both. Exercise machines exist that do provide both resistance and weight training, but a user must first have access to such an elaborate and expensive machine. Furthermore, a user must reconfigure the machine or his position in order to exploit either a resistance or weight workout. Dumbbells have existed for many years and are a great mobile device to provide weight training. A user can achieve some resistance training with a dumbbell, but this again requires re-positioning the body or merely resisting the drop/fall of the weight as one lowers the dumbbell during a rep. Similarly, resistance bands can achieve some weight training, but the same problems are encountered as described with the dumbbell. It is an objective of this invention to provide weight and resistance training in the same motion, without re-configuring the device or re-positioning the body. It is a further objective of this invention to exploit the dual weight/resistance training to create an efficient workout for a user. It is a further objective of this invention to enable a user to selectively adjust the length and tension of the bands providing resistance while the device is in use. An additional benefit is to provide a weight/resistance device that is highly mobile and simplified.

SUMMARY OF THE INVENTION

The principles of the present invention provide for strength training devices that incorporate both free weights and bands. Such devices enable exercise routines that incorporate the best of both free weights and bands and which would be difficult or impossible to do with just weights or just bands. Beneficially such devices can be made relatively low in cost while taking up relatively little space. Ideally the devices allow quick and easy changing of bands as well as the almost natural feel of free weights.

Dumbbells with resistance bands that are in accord with the present invention include a first dumbbell having a first weight with a first tensioning section having a first slot. The first dumbbell also includes a second weight having a second tensioning section with a second slot and a first rod-shaped elongated handle that connects the first weight to the second weight. Such dumbbells with resistance bands further include a second dumbbell having a third weight with a third tensioning section having a third slot. The second dumbbell further includes a fourth weight having a fourth tensioning section with a fourth slot and a second rod-shaped elongated handle connecting the third weight to the fourth weight. A first elastic band is wrapped around the first handle and extends from the first slot. The first elastic band is also wrapped around the second handle and extends from the third slot. In addition, a second elastic band is wrapped around the first handle and extends from the second slot. The second elastic band is also wrapped around the second handle and extends from the fourth slot.

The dumbbells with resistance bands may include a padded cover over the first handle and possibly indicia on the first handle. In practice, the first weight may be cylindrical and/or it may be internally filled. Preferably the first handle is rotatable relative to the first weight and it may include a band aperture for receiving the first band such that when the first handle rotates the first band wraps around the first handle. In that case the first tensioning section may include a band accumulation cavity that houses the wrapped band.

Preferably, the dumbbells with resistance bands include a locking mechanism that passes through the first weight to lock the first handle in place relative to the first weight. Beneficially, that locking mechanism is spring biased to lock the first handle in place relative to the first weight. In practice, the locking mechanism includes a post, the first handle includes a post aperture, and when the post is in the post aperture the first handle is locked in place relative to the first weight. The locking mechanism may also include an actuator button that is operatively connected to the post such that the post is removed from the post aperture when the actuator button is pulled. Ideally, the actuator button is external accessible on the first weight.

The first handle may include a retaining ring, the first weight may include a retaining ring slot, and the retaining ring is biased into the retaining ring slot. The locking mechanism may also include a retaining bolt inserted in the first handle. That retaining bolt provides a locking mechanism mount for retaining the locking mechanism to the first handle. Usefully, the tension of the first band depends on how much of the first band forms the wrapped band. The tension of the first band is reduced when the wrapped band is reduced. Usefully, the first elastic band is removable and it may be comprised of rubber.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
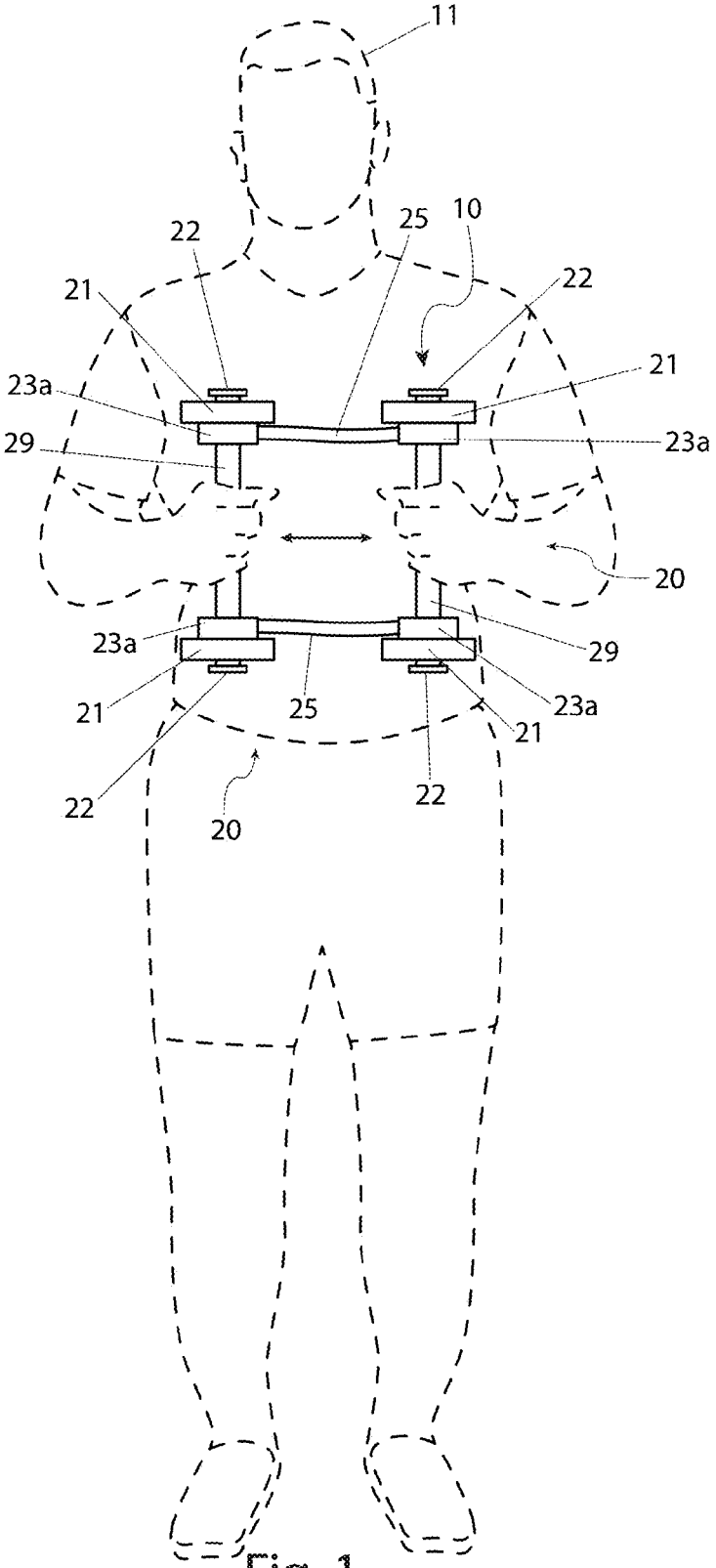
FIG. 1 is an environmental view of a dumbbell with resistance bands 10, according to a preferred embodiment of the present invention.

10 dumbbell with resistance bands
11 user
20 dumbbell
21 weighted portion
22 locking mechanism
23*a* tensioning section
23*b* band accumulation cavity
24 slot
25 band
26 post
27 post aperture
28*a* retaining ring
28*b* retaining ring slot
29 handle
30 band aperture
40 cover
42 indicia
43 actuator button
44 spring cavity
46 retaining bolt
48 retaining washer
50 spring

DETAILED DESCRIPTION OF THE PREFERRED EMBODIMENT

The best mode for carrying out the invention is presented in terms of its preferred embodiment, herein depicted within FIGS. 1 through 3*c*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Referring now to FIG. 1, an environmental view of the dumbbell with resistance bands (herein described as the "apparatus") 10, according to the preferred embodiment of the present invention, is disclosed. The apparatus 10 provides enhanced exercising equipment comprising a pair of specially designed dumbbells 20. Each dumbbell 20 comprises a pair of weighted portions 21, a pair of tensioning sections 23*a*, a handle 29, and a pair of connecting elastic bands 25. The bands 25 provide resistance training while pulling the dumbbells 20 apart. The resistance along with the weight of the dumbbells 20 provides an enhanced workout. A user 11 is envisioned to perform various exercises which maximize a full body and free range workout such as, but not limited to: butterflies, shoulder presses, chest presses, bicep curls, or the like.

Figure 2:
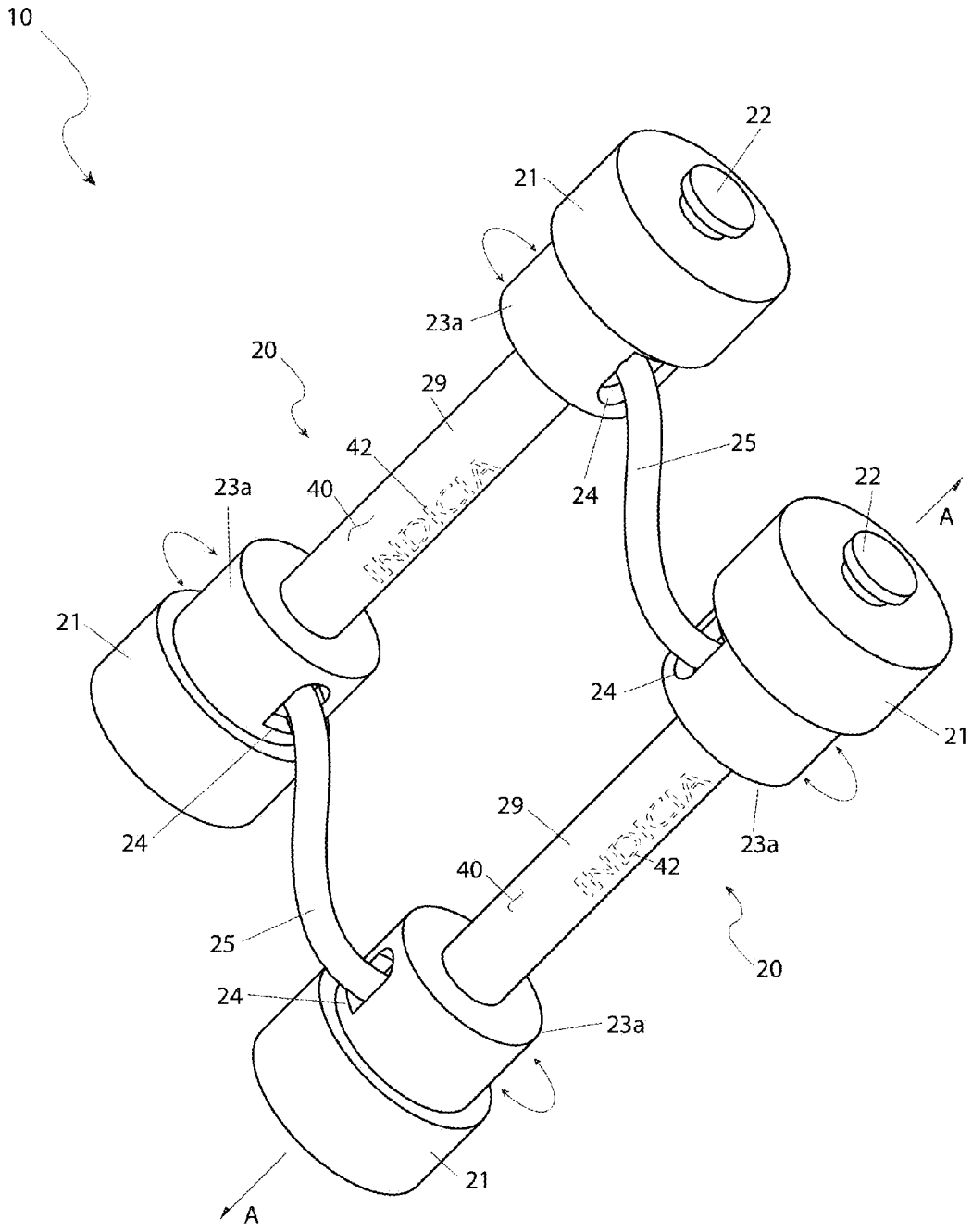
FIG. 2 is a perspective of the dumbbell with resistance bands 10, according to a preferred embodiment of the present invention.

Referring now to FIG. 2, a perspective view of the apparatus 10, according to the preferred embodiment of the present invention, is disclosed. The dumbbells 20 are interconnected by bands 25 to provide combined weight and resistance training. Each weighted portion 21 is comprised of a cylinder-shaped metal member preferably fabricated from titanium; however, other metal materials may be utilized. Additionally, the dumbbells 20 may be filled internally with materials such as sand without limiting the scope of the invention. Between each pair of weighted portions 21 is a rod-shaped handle 29 which provides a surface area for the user 11 to grip. The handles 29 are envisioned to comprise a padded gel or rubber cover 40 being adhesively or otherwise bonded thereto an outer surface to provide comfort to the user 11 while in use. The cover 40 may also provide indicia 42 to provide script or logos based upon a user's preference and may include images such as, but not limited to, sports names/logos, personal names, symbols, pictures, and the like to further customize and personalize the apparatus 10 further comprising a variety of colors and patterns.

The tensioning section 23*a* comprises an integral portion of the weighted portion 21 also being cylindrical in shape and protruding from an inward surface between the weighted portion 21 and the handle 29. Each tensioning section 23*a* provides an inner band accumulating cavity 23*b* for accumulating a section of the band 25 so as to adjust an exposed length of said band 25 (see FIGS. 3*a* through 3*c*).

The bands 25 are fabricated from an elastic rubber material, yet other materials may be utilized without limiting the scope of the invention. The bands 25 are removably attached to the dumbbells 20 and may be replaced with additional accessory bands 25 providing different degrees of elasticity so as to increase or decrease the resistance workout. It is further envisioned for the apparatus 10 be provide with other accessory bands 25 having different lengths which enable attachment onto a stationary structure, a user's feet, or the like, thereby enabling the performance of additional exercises.

Figure 3A:
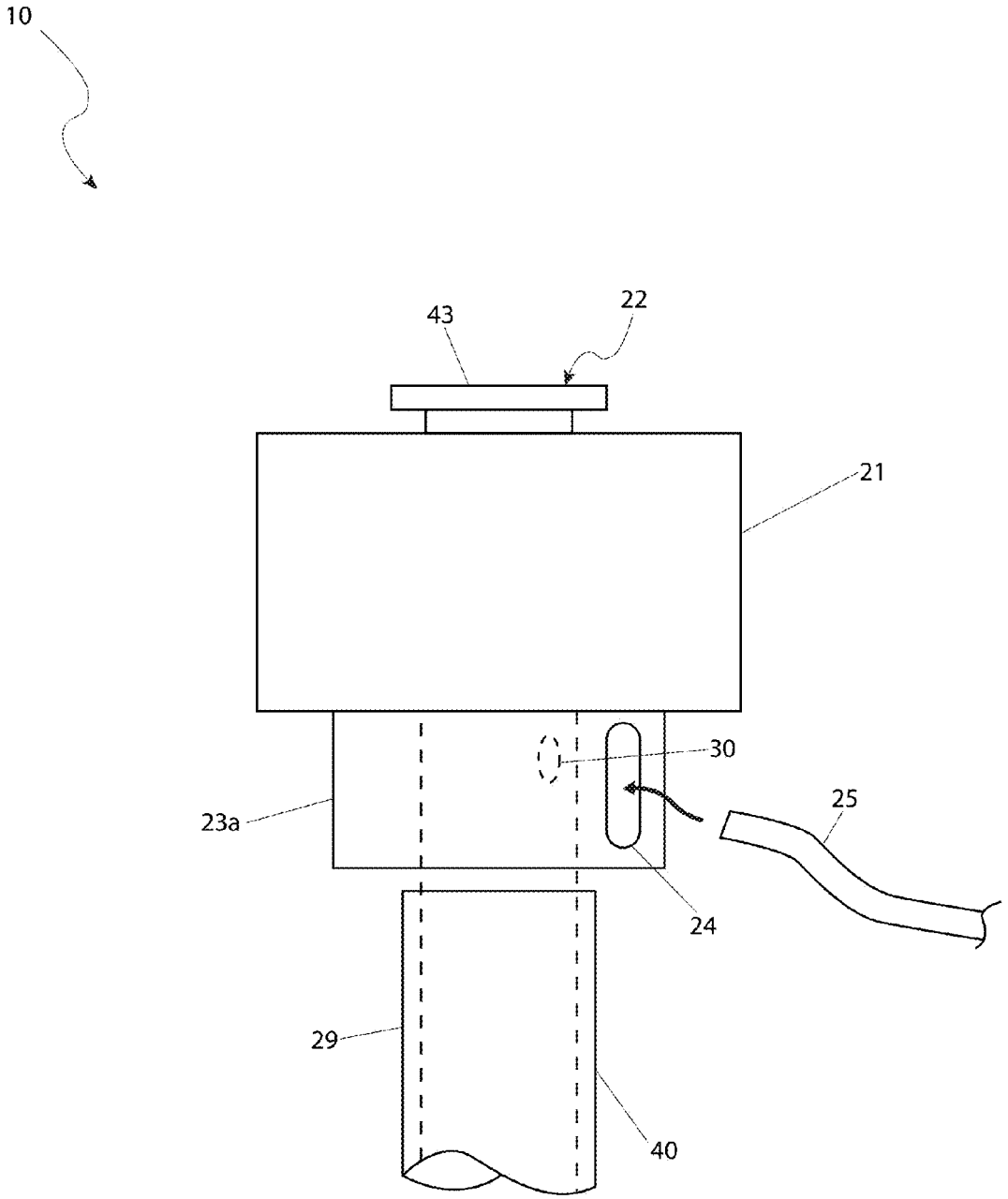
FIG. 3*a* is a side view of an end portion of the dumbbell with resistance bands 10, according to a preferred embodiment of the present invention.
Figure 3B:
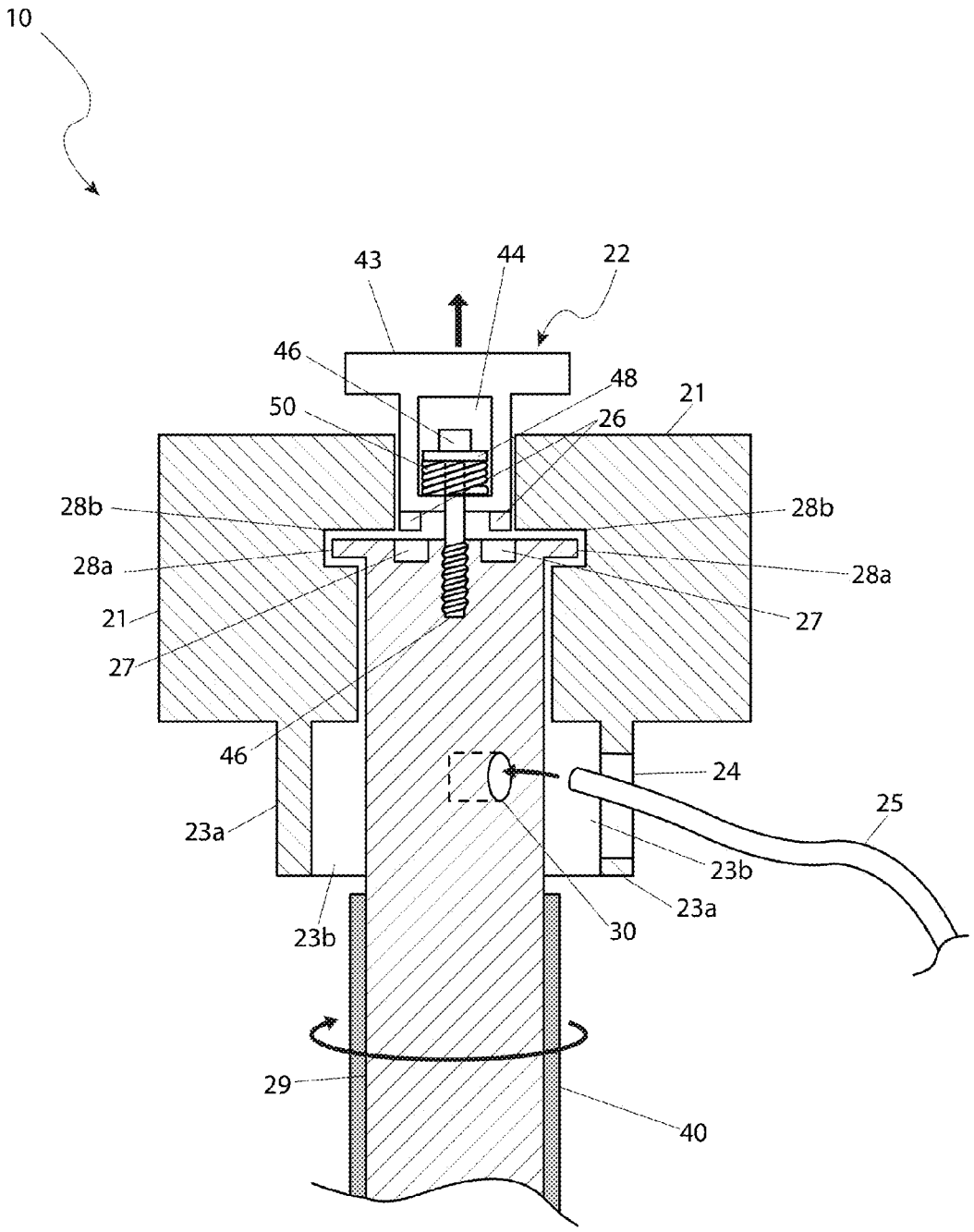
FIG. 3*b* is a sectional view of the dumbbell with resistance bands 10 taken along line A-A (see FIG. 2), depicting insertion of a band 25, according to a preferred embodiment of the present invention; and, FIG. 3*c* is another sectional view of the dumbbell with resistance bands 10 taken along line A-A (see FIG. 2), depicting internal winding of the band 25, according to a preferred embodiment of the present invention.
Figure 3C:
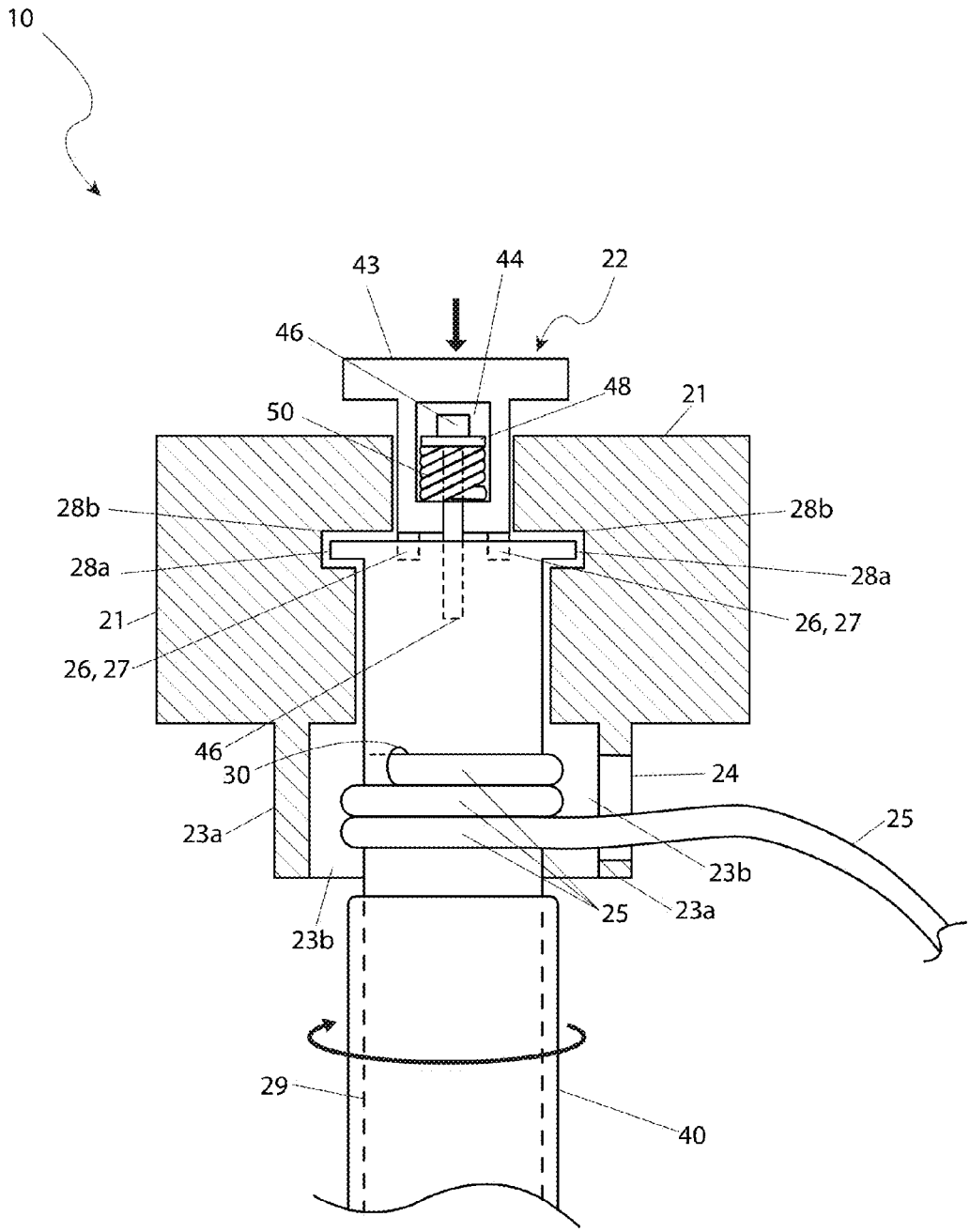

Referring now to FIGS. 3*a*, 3*b*, and 3*c*, front and sectional views of the apparatus 10, according to the preferred embodiment of the present invention, are disclosed. The two (2) weighted portions 21 of each dumbbell 20 are envisioned to be identical; therefore, a single end portion of the dumbbell 20 is shown here for illustration purposes. The apparatus 10 provides internal features which enable a user 11 to removably attach a band 25 as well as select an exposed length of said band 25.

Attachment and securement of the band 25 to the dumbbell 20 is accomplished by inserting an end portion of said band 25 through a slot portion 24 located along a side surface of the tensioning section 23*a*, and subsequently into a band aperture feature 30 formed in the handle 29. The handle 29 is then rotated with respect to the weighted portion 21 causing the band 25 to be wound around a portion of the handle 29 located within the cylindrical band accumulation cavity 23*b*. Upon winding a desired length of the band 25 within said band accumulation cavity 23*b*, a locking mechanism 22 is released to secure the position of the handle 29. The procedure is to be repeated for each end of each band 25 until the apparatus 10 is configured with desired band lengths.

The lengthening or shortening of the bands 25 is envisioned to increase or decrease the resistant dynamic of the apparatus 10. A shorter length of the bands 25 is envisioned to increase the resistance and a longer length of said bands 25 is envisioned to decrease the resistance. Each handle 29 is rotatingly captivated within a weighted portion 21 via retaining ring 28*a* and corresponding retaining ring slot 28*b* portions, respectively. The weighted portion 21 further provides a means to selectively arrest rotation of said handle 29 within the weighted portion 21 via a locking mechanism 22.

When a desired length of a band 25 is obtained, a respective locking mechanism 22 is engaged to fix the length of said band 25. Each locking mechanism 22 comprises an actuator button 43, a central cylindrical spring cavity 44, a retaining bolt 46, a retaining washer 48, and a spring 50. Each locking mechanism 22 comprises a cylindrically-shaped structure which extends downwardly into a top surface of the weighted portion 21. Each locking mechanism 22 comprises a spring-returned actuator button 43 upon an upper surface, and a pair of posts 26 along a bottom perimeter edge. As the actuator button 43 is lifted up or released to a lowered position, the posts 26 engage or disengage corresponding post aperture portions 27. The post apertures 27 are arranged in an equally-spaced circular pattern along a top surface of the handle 29. The internal spring cavity 44 provides a spring-return function to maintain engagement of the posts 26 with corresponding post apertures 27, thereby securing the handle 29 in a selected position.

The spring cavity 44 provides a means to return the locking mechanism 22 to a lowered and engaged state. The spring cavity 44 contains the retaining bolt 46, retaining washer 48, and spring 80 portions within. The retaining bolt 46 is preferably a shoulder bolt, which is threadingly attached to an end portion of the handle 29. Said retaining bolt 46 provides a mounting means to a retaining washer 48 and a subjacent coil-type spring 80 which in turn acts upon an inner bottom surface portion of the spring cavity 44 to bias the locking mechanism 22 downwardly to an engaged position. To wind the band 25, a user 11 releases the locking mechanism 22 by lifting the actuator button 43, rotates the handle 29 to shorten or lengthen the band 25, and releases the actuator button 43 to reengage the posts 26 with the post apertures 27.

It is understood that other non-rotating locking devices may be utilized within the apparatus 10 without deviating from the teachings of the apparatus 10, and as such should not be interpreted as a limiting factor of the present invention.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 and 2.

The method of utilizing the apparatus 10 may be achieved by performing the following steps: acquiring a model of the apparatus 10 having a desired number of bands 25 having respective desired elasticity characteristics; selecting a desired pair of bands 25 based upon a particular exercise routine and a user's preference; attaching an end portion of a band 25 to a dumbbell 20 by aligning the slot portion 24 of the tensioning section 23*a* with the band aperture portion 30 of the handle 29; inserting the end portion of the band 25 through the slot 24 and into the band aperture 30; pulling upwardly upon the actuator button portion 43 of the locking mechanism 22 to disengage the posts 26 and post apertures 27; adjusting the length of the band 25 by rotating the handle 29; securing the handle 29 in position by releasing the actuator button 43 to engage the post 26 and post aperture 27 portions; repeating the above steps for the remaining ends of the bands 25 and remaining dumbbell 20; grasping and motioning the handle portions 29 of each dumbbell 20 to perform a desired exercise; and, benefiting from various combined weight and resistance exercises afforded a user 11 of the present invention 10.

To enable the performance of additional workouts, the band portions 25 of the apparatus 10 may be replaced with additional accessory bands 25 comprising different degrees of elasticity so as to increase or decrease the resistance element of the workout. Furthermore, a user 11 may install additional accessory bands 25 having different lengths which enable attachment or looping of said bands 25 to a structure or a body part such as a foot, thereby enabling the performance of even more exercises.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. Dumbbells with resistance bands, comprising:

a first dumbbell having a first weight with a first tensioning section having a first slot, said first dumbbell further including a second weight having a second tensioning section with a second slot, said first dumbbell further including a first rod-shaped elongated handle connecting said first weight to said second weight;

a second dumbbell having a third weight with a third tensioning section having a third slot, said second dumbbell further including a fourth weight having a fourth tensioning section having a fourth slot, said second dumbbell further including a second rod-shaped elongated handle connecting said third weight to said fourth weight;

a first elastic band wrapped around said first handle and extending from said first slot, said first elastic band also wrapped around said second handle and extending from said third slot; and, a second elastic band wrapped around said first handle and extending from said second slot, said second elastic band also wrapped around said second handle and extending from said fourth slot.

2. The dumbbells with resistance bands according to claim 1, further comprising a padded cover over said first handle.

3. The dumbbells with resistance bands according to claim 2, further including indica on said first handle.

4. The dumbbells with resistance bands according to claim 1, wherein said first weight is cylindrical.

5. The dumbbells with resistance bands according to claim 1, wherein said first weight is internally filled.

6. The dumbbells with resistance bands according to claim 1, wherein said first handle is rotatable relative to said first weight.

7. The dumbbells with resistance bands according to claim 6, wherein said first handle includes a band aperture for receiving said first band such that when said first handle rotates in a first direction said first band wraps around said first handle.

8. The dumbbells with resistance bands according to claim 7, wherein said first tensioning section includes a band accumulation cavity that houses said wrapped band.

9. The dumbbells with resistance bands according to claim 8, further including a locking mechanism that passes through said first weight to lock said first handle in place relative to said first weight.

10. The dumbbells with resistance bands according to claim 9, wherein said locking mechanism is spring biased to lock said first handle in place relative to said first weight.

11. The dumbbells with resistance bands according to claim 10, wherein said locking mechanism includes a post, wherein said first handle includes a post aperture, and wherein when said post is in said post aperture said first handle is locked in place relative to said first weight.

12. The dumbbells with resistance bands according to claim 11, wherein said locking mechanism further includes an actuator button operatively connected to said post, wherein said post is removed from said post aperture when said actuator button is pulled.

13. The dumbbells with resistance bands according to claim 12, wherein said actuator button is external accessible on the first weight.

14. The dumbbells with resistance bands according to claim 13, wherein said first handle includes a retaining ring, where said first weight includes a retaining ring slot, and wherein said retaining ring is disposed in said retaining ring slot.

15. The dumbbells with resistance bands according to claim 13, wherein said locking mechanism further includes a retaining bolt inserted in said first handle, said retaining bolt providing a locking mechanism mount retaining said locking mechanism to said first handle.

16. The dumbbells with resistance bands according to claim 8, wherein the tension of said first band depends on how much of said first band forms said wrapped band.

17. The dumbbells with resistance bands according to claim 16, wherein the tension of said first band is reduced when said wrapped band is reduced.

18. The dumbbells with resistance bands according to claim 1, wherein said first elastic band is removable.

19. The dumbbells with resistance bands according to claim 18, wherein said first elastic band is rubber.

* * * * *